US006311607B1

(12) United States Patent
Müller

(10) Patent No.: US 6,311,607 B1
(45) Date of Patent: Nov. 6, 2001

(54) DEVICE FOR ALTERING THE DISPLACEMENT VOLUME OF A HYDROSTATIC MACHINE

(75) Inventor: Norbert Müller, Neu Ulm (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 0 days.

(21) Appl. No.: 09/554,340

(22) PCT Filed: Nov. 10, 1998

(86) PCT No.: PCT/EP98/07176

§ 371 Date: May 11, 2000

§ 102(e) Date: May 11, 2000

(87) PCT Pub. No.: WO99/25953

PCT Pub. Date: May 27, 1999

(30) Foreign Application Priority Data

Nov. 14, 1997 (DE) ..... 197 50 614

(51) Int. Cl.[7] ..... F01B 3/00
(52) U.S. Cl. ..... 92/12.2
(58) Field of Search ..... 91/497, 505; 92/12.1, 92/12.2

(56) References Cited

U.S. PATENT DOCUMENTS 4,934,252 * 6/1990 Giere ..... 91/497
5,142,940 9/1992 Hasegawa ..... 92/12.2
5,622,051 4/1997 Iida et al. ..... 60/487

FOREIGN PATENT DOCUMENTS 1528808 2/1970 (DE) .
2333083 1/1975 (DE) .
2620524C2 12/1997 (DE) .
0386738A2 9/1990 (EP) .

* cited by examiner

*Primary Examiner*—F. Daniel Lopez
(74) *Attorney, Agent, or Firm*—Scully, Scott, Murphy & Presser

(57) ABSTRACT

A device (213) for altering the displacement volume of a hydrostatic machine (1) has an actuator (3) which can be moved in a direction of adjustment and back in a resetting direction and is connected to a component of the hydrostatic machine (1) which adjusts the displacement volume, a spring (6) supported on a component (7*a*) of the axial piston machine (1) secured to the housing and a spring leg (6*a*) linked to the actuator (3) for spring-loading the actuator (3) in the resetting direction (5*b*). An adjusting device (8) for adjusting the actuator (3) in its zero position is arranged between the spring leg (6*a*) and the actuator (3) and has an adjusting element (11) for adjusting the actuator (3) relatively to the spring leg of the adjusting device.

9 Claims, 4 Drawing Sheets

DEVICE FOR ALTERING THE DISPLACEMENT VOLUME OF A HYDROSTATIC MACHINE

In hydrostatic machines which are adjustable in respect of their displacement volume, more particularly axial piston machines, a zero position setting is required both in machines in which the adjustment member is adjustable from its zero position into a position of maximum displacement volume and back again and in machines in which the adjustment member is adjustable beyond its zero position, since it is scarcely possible to predetermine the zero position in a fixed manner on account of the manufacturing tolerances which are present in the adjustment mechanism.

A known measure of setting the zero position consists, for example, in the case of an adjustment member in the form of a pivot lever mounted on a shaft, in slotting the bearing eye of the pivot lever and, by means of a clamping screw penetrating the slot, constructing the pivot lever as a clamping device. In this design, which has long been known, the zero position can be set manually by releasing the clamping screw of the pivot lever, adjusting the adjustment mechanism into the exact zero position and then tightening the clamping screw, so that the pivot lever is securely connected to the shaft. In this known device, there is a danger of the clamping device working loose in the long term. In addition, the zero position setting is difficult since it is scarcely possible to carry out a controlled adjustment movement when manually pivoting the pivot lever on the shaft. There is also a danger, either before or during the locking of the pivot lever on the groove by tightening the clamping screw, of the setting being accidentally changed again.

In a device described in DE-OS 23 33 083 for adjusting the displacement volume of a hydrostatic machine, an adjustment member in the form of a pivot lever is provided, which is pivotably mounted independently of two bearing journals of a so-called tapered washer and is drivably connected to the tapered washer by a lever mechanism. In this known design, a zero position setting device is formed by a locking mechanism with a radial groove, which is arranged on an end face of the bearing shaft of the pivot lever and into which a resiliently mounted ball can lock, which is arranged eccentrically in a rotatably mounted bush relative to the pivoting axis of the pivot lever. In this known design, it is necessary when adjusting the displacement volume to overcome a locking point, which disturbs the adjustment movement.

A device of the initially described type is described in DE 26 20 524 C2 for adjusting the displacement volume of an axial piston machine with an external adjustment lever, on whose pivoting shaft an inner restoring lever is rigidly secured, which comprises a driving journal, which projects parallel to the pivoting shaft and is centered between two spring limbs of a helical spring, which engage around the driving journal and an abutment journal fixedly arranged on the housing, so that the driving journal and therefore the pivoting lever is also elastically centered between the spring limbs. In this known device, a setting device for setting the zero position in the region of the pivoting lever is not provided. Nor it is ensured that the centering is free of clearance.

It is the object of the invention to develop a device of the initially stated type in such a manner that a setting of the zero position is possible whilst ensuring a simple construction.

In the device according to the invention a setting device is provided, which is fitted into the connection between the spring limb and the adjustment member. In this manner, not only is a simple arrangement and reliable function ensured, but also a simple design and good accessibility, which results in cost-effective manufacture and easy handling during setting of the zero position. In addition, the design according to the invention, which is of small construction, can be easily integrated into the device.

In the case of an adjustment which is pivotable about a pivoting axis, a helical spring is suitable as a spring, a spring limb projecting from one end and a different spring limb projecting from the other end of the helical spring and acting between an abutment element fixed to the housing and the pivotable adjustment member. A spring of this type is particularly suitable for centered positioning of the adjustment member in its zero position, the abutment element being clamped between the limbs, so that the centering is ensured.

Within the framework of the invention, it is possible to construct the setting device with an adjustment member which can be adjusted over a path extending in the adjustment device either manually or by means of an adjustment gearing. The latter design also allows for the arrangement of a step-down gearing, so that not only simple handling during setting is possible as a result of the presence of the gearing, but also a fine setting as a result of the step-down gearing. A rotatable eccentric, for example, which forcibly effects the setting movement of the setting member when manually rotated, is suitable as a step-down gearing. For the restoring movement of the setting member, the tension of the spring can be exploited.

It is also advantageous to arrange the setting device in protected fashion between the hydrostatic machine and the adjustment member and to provide a setting mechanism, which is accessible from the outside of the adjustment member. This allows for ease of handling during the setting of the zero position.

A particularly simple development of the invention consists in arranging the setting member in a guide groove extending transversely to the associated spring limb in an adjustable and selectively lockable manner, e.g. by means of a clamping device. Both this embodiment and the embodiment with the eccentric described above allow for continuously variable setting of the zero position.

The invention and further advantages obtainable by way of the invention will be explained in further detail in the following with the aid of preferred embodiments and drawings. In the drawings.

Figure 1:
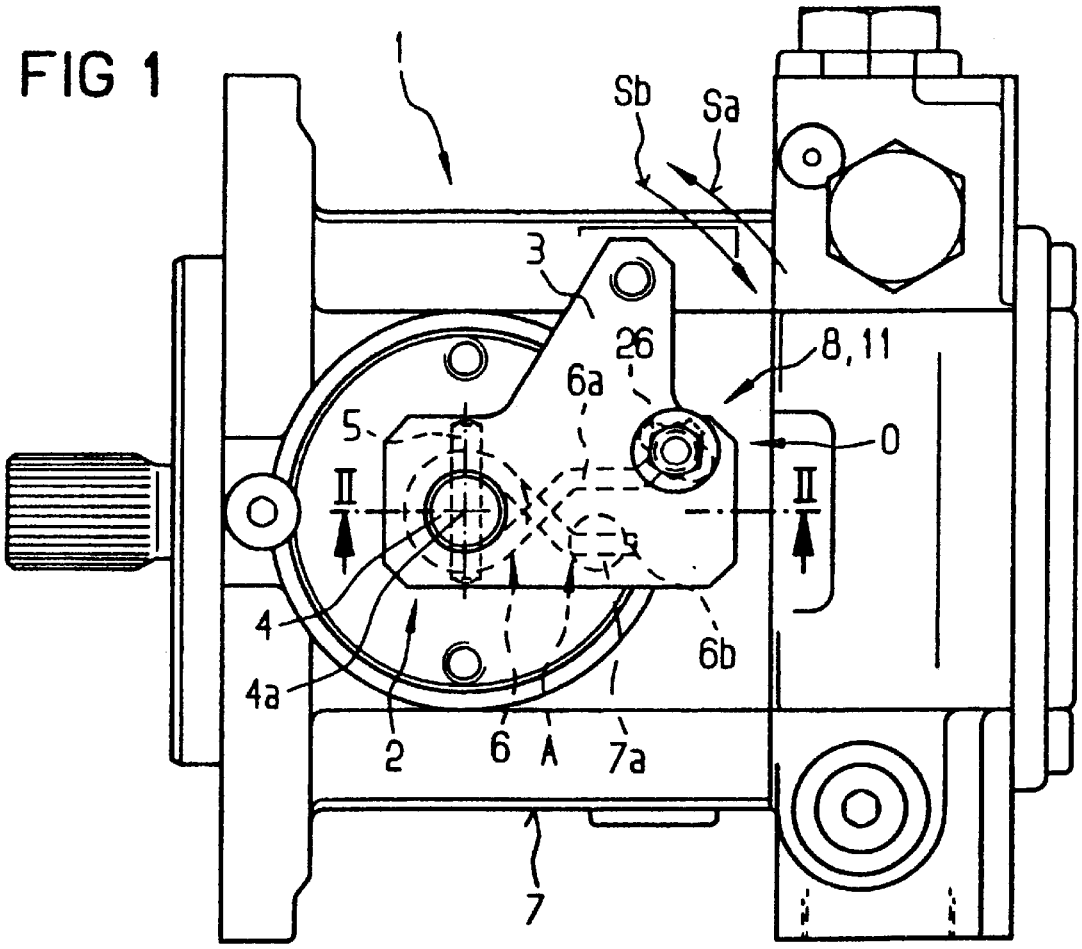
FIG. 1 is a side view of a hydrostatic machine with a device according to the invention for varying the displacement volume.

The hydrostatic machine generally designated by the reference 1 is preferably an axial piston machine with a plurality of pistons, which are arranged on a graduated circle, are displaceable in cylinder bores and are connected for a drive function of a so-called tapered washer or a comparable support device. There are various known constructions which are based upon the design principle described above and which do not therefore need to be described.

The hydrostatic machine 1 illustrated in the external view comprises a device 2 for varying the displacement volume of the hydrostatic machine 1 with an adjustment member 3, which is connected to a component of the hydrostatic machine 1 adjusting the displacement volume. There are devices 2, whose adjustment member carries out a linear adjustment movement, for example. In the present embodiment, the adjustment member 3 is an adjustment lever, which is mounted on a shaft 4, which is connected to the drive device for the pistons, in this case a tapered washer, for example. The adjustment member 3 can sit with a bearing eye on the shaft 4 and can be securely connected to the shaft 4 by a cross pin 5.

Figure 3:
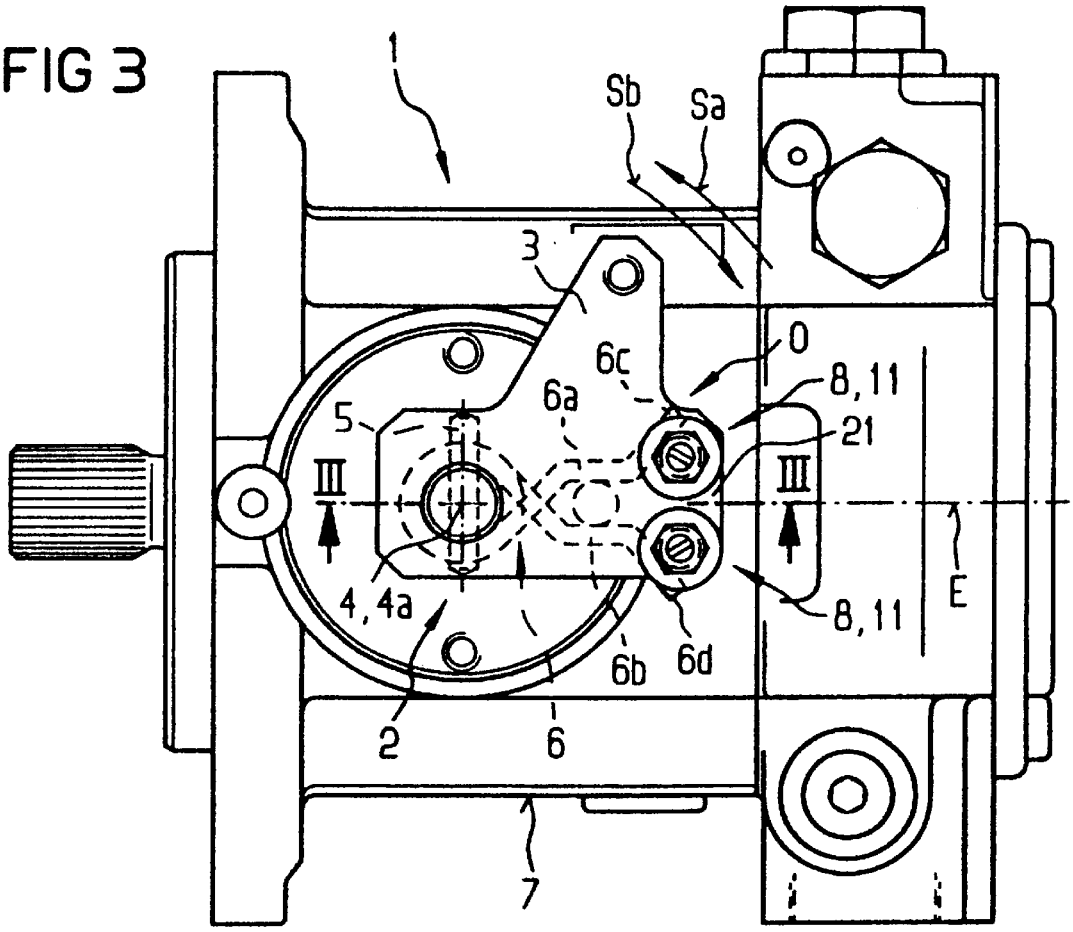
FIG. 3 is a side view of a hydrostatic machine with a modified embodiment of a device according to the invention for varying the displacement volume.

The adjustment member 3 is pivotable by a drive element, not shown, e.g. a pushrod, between the so-called zero position 0 illustrated in FIG. 1, in which the hydrostatic machine 1 does not displace any hydraulic medium, into a pivoting position illustrated in FIG. 3, in which the hydrostatic machine 1 is adjusted to a maximum displacement volume for example. In order to return the adjustment member 3 to its zero position, a spring 6 is provided, which is supported on a component 7*a* fixedly arranged on the housing 7 and acts with a spring limb 6*a* upon the adjustment member 3.

The adjustment movement of the adjustment member 3 is a pivoting movement, the circular arc-shaped adjustment direction out of the zero position being designated by the reference 5*a* and the return direction by 5*b*.

Figure 6:
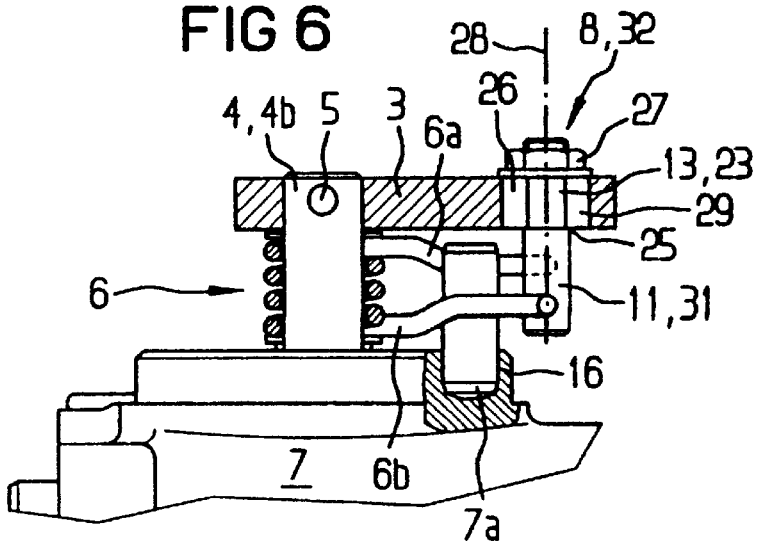
FIG. 6 is a partial section taken along line VI—VI in FIG. 5.

Owing to manufacturing tolerances which can scarcely be avoided during the manufacture of the individual parts of the axial piston machine 1, a setting device, generally designated by the reference 8, is required for setting the device 2 or the adjustment member 3 in the zero position 0. The setting device 8 is integrated into the connection between the spring limb 6*a* and the adjustment member 3 and is therefore arranged on the adjustment member 3 at a distance from the pivoting axis 4*a*. By means of the setting device 8, the adjustment member 3 can be continuously variably adjusted on its adjustment path relative to the spring limb 6*a* and locked in the respective adjustment position. To this end, a setting member 11 is used, which can be fitted into the connection between the spring limb 6*a* and the adjustment member 3 and can be adjusted either directly by hand in a manner described below or by a setting gearing 12 (FIG. 4) described below, which can preferably be formed by a step-down gearing for the purpose of fine adjustment, e.g. with an eccentric, or by a connecting element 13 (FIGS. 2 and 6), which will be described below and can be connected to the adjustment member 3 in continuously variably adjustable positions.

In the present embodiments, the spring 6 is a helical spring, whose coils enclose the shaft 4 with a slight clearance and whose ends are formed as two substantially radially projecting spring limbs 6*a*, 6*b*. In the embodiment according to FIGS. 1 and 2, the limb 6*b* supported on the housing 7 is fixed on both sides, e.g. in a slot 7*b* of the component 7*a*.

In the embodiments according to FIGS. 3 to 6, the spring limbs 6*a*, 6*b* engage on both sides around the component 7*a* fixed to the housing and are prestressed relative to one another and therefore clamp the component 7*a* between them. In the present embodiments, the component 7*a* in each case forming an abutment A for the spring limb 6*b* or for the spring limb 6*a* is formed by a journal, which is fixedly fitted into an aperture 16 in the housing 7 at a radial distance from the shaft end 4*b* projecting from the housing 7. The spring 6 is disposed in a protected manner between the adjustment member 3 and the housing 7 in a specially provided spacing region.

In the embodiments according to FIGS. 3 to 7, setting devices 8*a*, 8*b* are provided, which are preferably of like construction. By means of the setting devices 8*a*, 8*b*, the adjustment member 3 is supported on the inside in each case against the spring limbs 6*a*, 6*b*. As a result of the support of the spring limbs 6*a*, 6*b* on both sides of the component 7*a* and as a result of the support of the adjustment member 3 on both sides of the spring limbs 6*a*, 6*b*, the adjustment member 3 is fixed by the spring 6 secured to the housing, a so-called central fixing being provided as a result of the fact that the spring limbs 6*a*, 6*b* enclose the component 7*a* elastically, the central fixing being generated by the equilibrium of the spring tensioning of the elastic spring limbs 6*a*, 6*b*. In order to obtain sufficient space for the setting devices 8*a*, 8*b*, the end sections 6*c*, 6*d* of the spring limbs 6*a*, 6*b* contacting said setting devices are bent in divergent fashion.

When the adjustment member 3 is pivoted into the pivoting position illustrated in FIG. 3, the spring limb 6*b*, driven by the setting device 8*b*, is bent outwards and also undertakes the restoring function during the return adjustment.

In all embodiments, the device 2 according to the invention can be designed for an adjustment movement from the zero position in an adjustment direction and/or in the opposite adjustment direction, i.e. can be adjusted beyond the zero position, which is possible in various types of hydrostatic machine and is usual in an axial piston machine, e.g. in order to reverse the direction of rotation during motor operation or to reverse the conveying direction during pump operation. During pivoting in the opposite outward pivoting direction (not shown), the other limb 6*a* is bent outwards by the setting device 8*a* and undertakes the restoring function.

Figure 4:
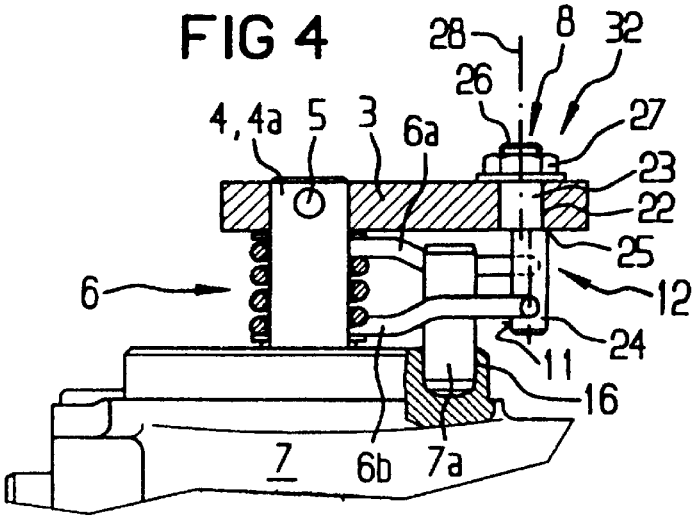
FIG. 4 is a partial section taken along line IV—IV in FIG. 3.
Figure 5:
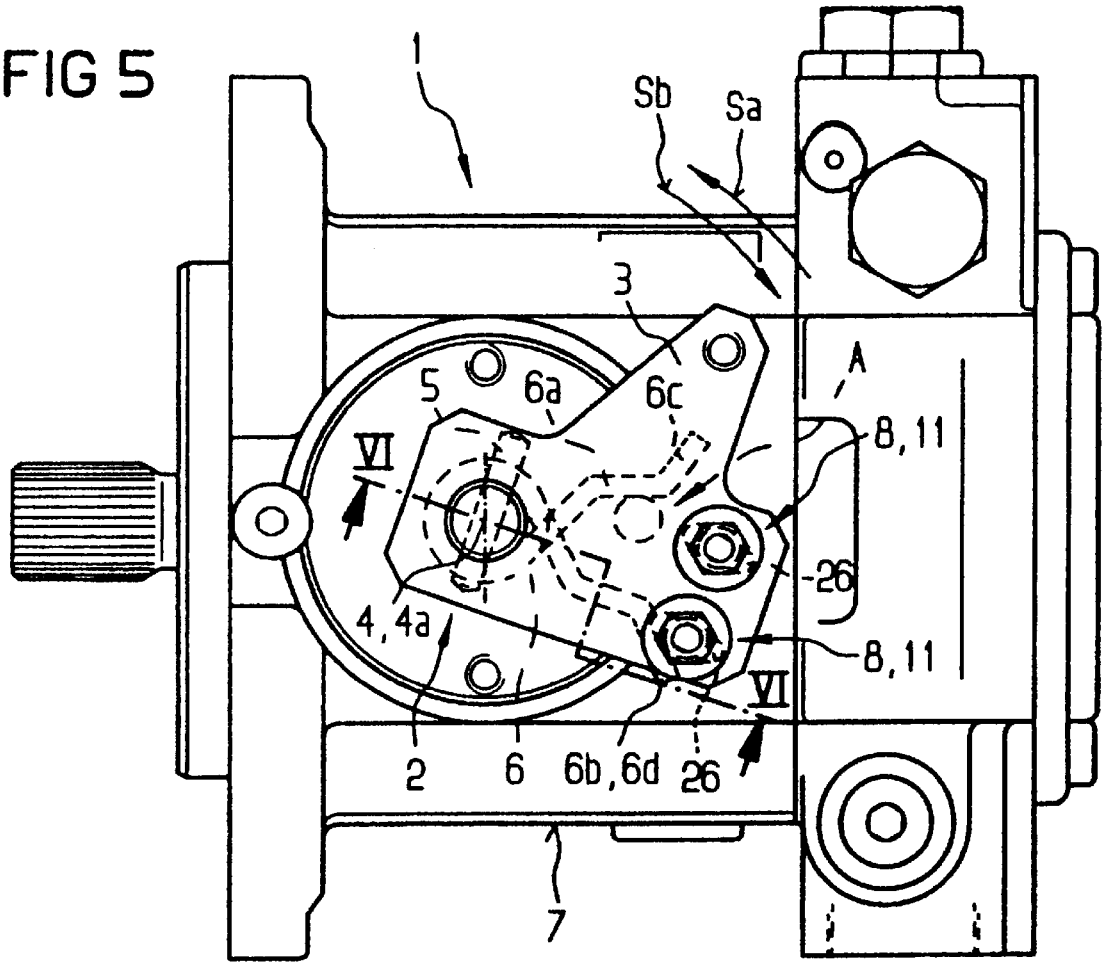
FIG. 5 shows a modified embodiment of the hydrostatic machine according to FIG. 3, in which the adjustment member is also adjusted from its zero position.

In the embodiment according to FIGS. 3 and 4, both setting devices 8*a*, 8*b* with the setting gearing 12 are of like construction. In the adjustment member 3, two round through apertures 22 are arranged in a lateral extension 21 of the adjustment member 3 constructed in the form of a plate-shaped lever on either side of a radial plane E extending in the pivoting axis of the shaft 4, a bolt 23 being rotatably mounted in each through aperture 22, which extends in its longitudinal direction on the inside of the adjustment member 3 by an eccentric 24, which forms an abutment shoulder 25 resting against the inside of the adjustment member 3. On the outside of the adjustment member 3, the pivoting bolt 23 comprises a thread and a tool attachment element 26, e.g. a screwdriver slot, into which a screwdriver can be inserted. The pivoting bolt 23 is held on the adjustment member 3 by means of a nut 27 screwed into place. The setting member 11 is formed by the cylindrical surface of the eccentric. By way of a loosening, rotation by means of an associated tool in one or the other direction of rotation and a tightening of the nut 27, the eccentric 24 can be adjusted into selected rotary positions, it being possible to adjust and set the distance between the central axis 28 of the bolt 23 and the point of contact between the associated limb end 6*c*, 6*d* and the eccentric 24 and therefore the position of the setting member 11. In this respect, the bolt 23 with the eccentric 24 respectively forms the forcibly effective setting gearing 12, which as a result of the construction with the eccentric 24 is a step-down gearing and allows for fine adjustment. Both setting devices 8*a*, 8*b* are to be adjusted in such a manner that the eccentrics 24 contact the spring limbs 6*a*, 6*b*.

Figure 2:
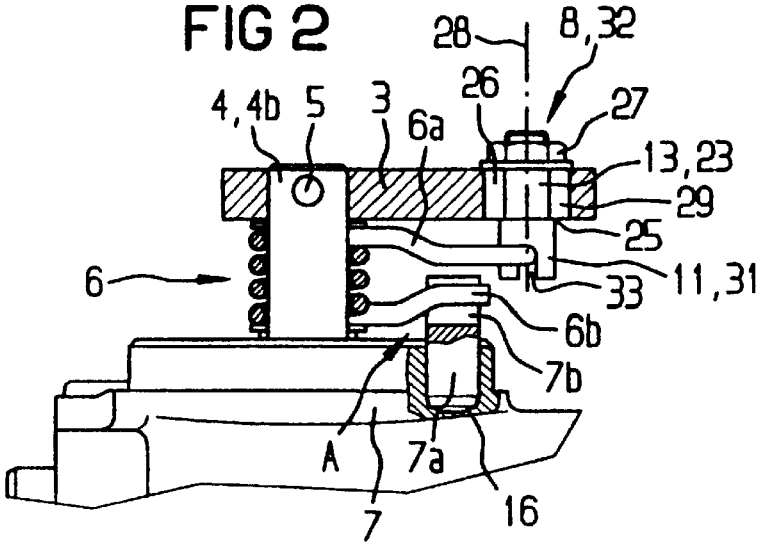
FIG. 2 is a partial section taken along line II—II in FIG. 1.

In the embodiment according to FIGS. 1 and 2 as well as 5 and 6, the setting devices 8*a*, 8*b* are constructed in the form of the connecting element 13, which in each case is adjustable relative to the adjustment member 3 in the adjustment direction 5*a*, 5*b* transversely to the associated spring limb 6*a*, 6*b* and can be locked in the respective adjustment position. To this end, a slot 29 extending transversely to the associated spring limb is used, in which the bolt 23 can be adjusted and locked by tightening the nut 27. In this embodiment, a cylindrical, thickened bolt section 31 coaxially adjoins the bolt 23 on the inside, said bolt section 31 also forming an abutment shoulder 25, which forms a clamping device 32 in the same manner as the previously described embodiment with the nut 27. In order to set the zero position in the embodiment (according to FIGS. 3 and 4), the bolt 23 is displaced directly by hand into the correct position resting against the associated spring limb. In the embodiment according to FIGS. 1 and 2, the spring limb 6*a* is fixed in the plane of movement, i.e. on both sides, to the setting member 11 formed by the bolt section 31, e.g. by engaging in an aperture or the opening of a slot 33.

Figure 7:
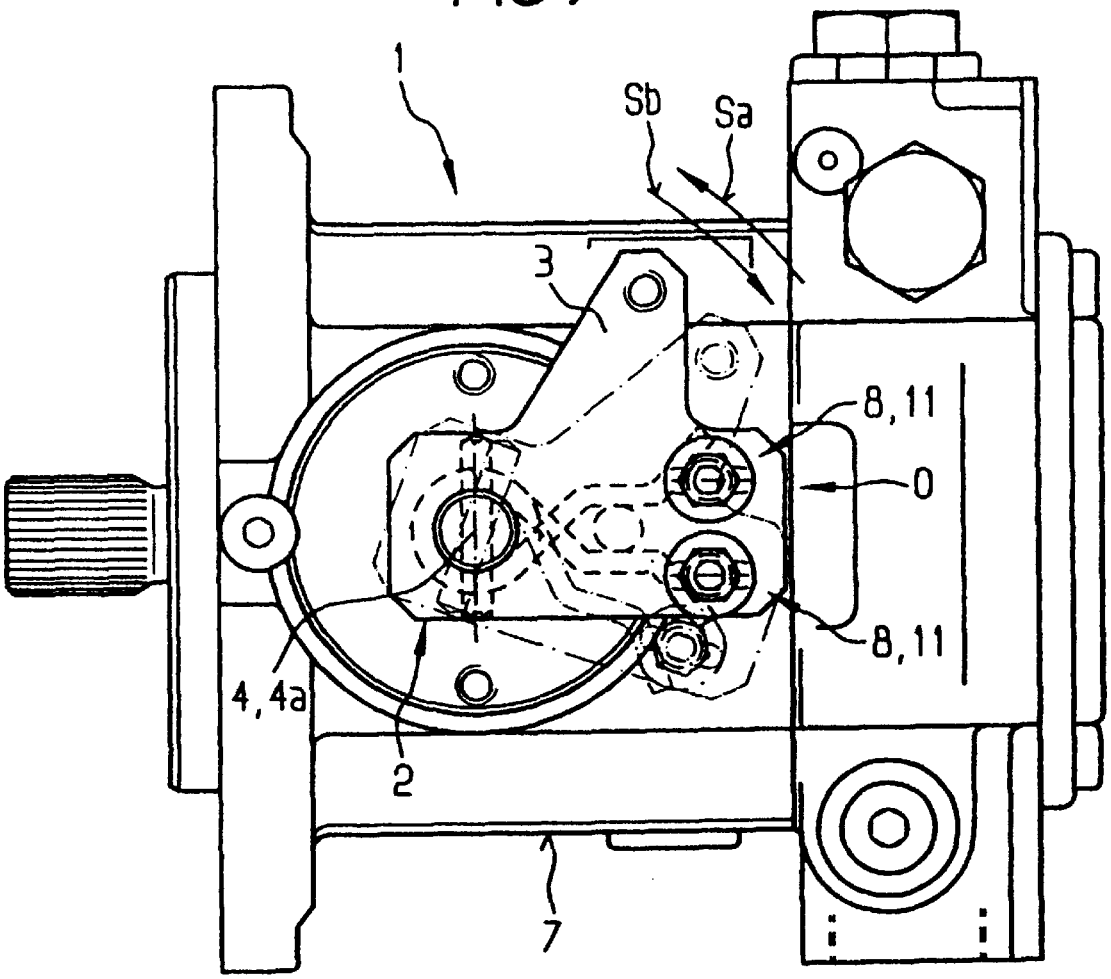
FIG. 7 shows the hydrostatic machine according to FIGS. 3 or 5 in two operating positions.

In FIG. 7, the restoring member 3 is illustrated in the zero position 0 by continuous lines and in a maximum deflection position, for example, by dot-dash lines.

What is claimed is:

1. A device (2) for varying the displacement volume of a hydrostatic machine (1), with an adjustment member (3), which is adjusted in an adjustment direction and back again in a restoring direction and is connected to a component of the hydrostatic machine (1) adjusting the displacement volume, a spring (6), which is supported on a component (7*a*) of the hydrostatic machine (1) fixed to a housing and comprises a spring limb (6*a*), which is connected to the adjustment member (3) and prestresses the adjustment member (3) in the restoring direction (5*b*), characterised in that a setting device (8) for setting the adjustment member (3) in its zero position is provided, which is arranged between the spring limb (6*a*) and the adjustment member (3) and comprises a setting member (11), by means of which the adjustment member (3) is adjusted relative to the spring limb.

2. A device according to claim 1, characterised in that the adjustment member (3) is arranged on a shaft (4) and is pivotably mounted, the spring (6) is a helical spring, which encloses the shaft (4) with a slight clearance of motion and whose ends form substantially radially projecting spring limbs (6*a*, 6*b*), which enclose the component (7*a*) fixed to the housing and are elastically prestressed against the component (7*a*), and the setting device (8) is arranged between each limb (6*a*, 6*b*) and the adjustment member (3).

3. A device according to claim 1, characterised in that the setting device (11) is adjustable by a setting gearing (12).

4. A device according to claim 3, characterised in that the setting gearing (12) is a step-down gearing.

5. A device according to claim 4, characterised in that the step-down gearing comprises an eccentric drive.

6. A device according to claim 5, characterised in that the setting device (11) is formed by a bolt (23), which is rotatably and lockably mounted on the adjustment member (3) and comprises an eccentric (24), which rests against the inside of the associated spring limb (6*a*, 6*b*).

7. A device according to claim 1 or 2, characterised in that the setting member (11) is formed by a bolt (23), which is adjustable in a slot (29) in the adjustment member (3) extending transversely to the associated spring limb and can be locked in the respective adjustment position.

8. A device according to claim 6 or 7, characterised in that the bolt (23) penetrates the adjustment member (3) and the adjustment member (3) can be locked in position between an abutment shoulder (25) of the bolt (23) and a nut (27) screwed onto the bolt (23) by tightening said nut (27).

9. A device according to one of the preceding claims, characterised in that the adjustment member (3) is arranged at a distance from the housing (7) of the axial piston machine (1), the spring (6) and the setting device (8) are arranged in the spacing region inbetween and the setting member (11) is accessible from the side of the adjustment member (3) remote from the housing (7).

* * * * *